United States Patent [19]

Nysten

[11] Patent Number: 4,751,773

[45] Date of Patent: Jun. 21, 1988

[54] SNAP FASTENER

[75] Inventor: Bernhard Nysten, Aachen, Fed. Rep. of Germany

[73] Assignee: William Prym-Werke GmbH. & Co. KG., Stolberg, Fed. Rep. of Germany

[21] Appl. No.: 855,162

[22] Filed: Apr. 23, 1986

[30] Foreign Application Priority Data

Apr. 25, 1985 [DE] Fed. Rep. of Germany ..... 3514896

[51] Int. Cl.[4] ..... A44B 17/00

[52] U.S. Cl. ..... 24/681; 24/662; 24/689

[58] Field of Search ..... 24/104, 106, 107, 108, 24/117 R, 113 MP, 618–624, 662, 679, 680–682, 687, 696, 689–693, 659

[56] References Cited

U.S. PATENT DOCUMENTS

| | | | |
|---|---|---|---|
| 1,229,562 | 6/1917 | Willetts | 24/681 |
| 1,604,020 | 10/1926 | Carr | 24/689 X |
| 2,018,635 | 10/1935 | Carr | 24/681 |
| 2,256,849 | 9/1941 | Purinton | 24/680 |
| 2,312,441 | 3/1943 | Reiter | 24/689 X |
| 2,759,238 | 8/1956 | Williams | 24/680 |
| 2,933,831 | 4/1960 | Le Compte | 24/659 X |
| 3,376,618 | 4/1968 | Schworzkopf | 24/662 X |
| 3,414,949 | 12/1968 | Andrews | 24/662 X |
| 3,551,963 | 1/1971 | Mosher, Jr. et al. | 24/662 X |
| 3,916,756 | 11/1975 | Yoda | 24/682 |

FOREIGN PATENT DOCUMENTS

| | | | |
|---|---|---|---|
| 379746 | 8/1923 | Fed. Rep. of Germany | 24/681 |
| 3336550 | 4/1985 | Fed. Rep. of Germany . | |

*Primary Examiner*—Kenneth J. Dorner
*Assistant Examiner*—James R. Brittain
*Attorney, Agent, or Firm*—Peter K. Kontler

[57] ABSTRACT

A snap fastener wherein the female component has an end wall with a rim extending from one side of the end wall and a centrally located elastically deformable female coupling element provided on a frustoconical central portion of the end wall. The central portion has a concave surface at the other side of the end wall. The male component has a mushroom-shaped male coupling element which can be forced, not unlike an arrowhead, the female coupling element from the concave side of the central portion of the end wall. The force which must be applied to extract the male coupling element from the female coupling element is several times the force which is required to insert the male coupling element because the central portion of the end wall yields more readily in a direction toward the one side of the end wall.

18 Claims, 5 Drawing Sheets

SNAP FASTENER

CROSS-REFERENCE TO RELATED CASES

Snap fasteners are disclosed in the commonly owned copending patent application Ser. No. 655,048, abandoned of Bernhard Nysten et al. for "Snap fastener unit" and in the commonly owned copending patent application Ser. No. 729,616, U.S. Pat. No. 4,596,349 of Ernst Herten for "Machine for applying articles of hardware to textile materials and the like".

BACKGROUND OF THE INVENTION

The present invention relates to snap fasteners in general, and more particularly to improvements in snap fasteners of the type wherein the male and female components of the fastener can be assembled with one or more discrete retaining and anchoring devices.

Commonly owned German Offenlegungsschrift No. 33 36 550 discloses a snap fastener wherein the female component is preassembled with an anchoring device so that it can be affixed to a carrier (for example, a sheet of textile material) by causing the prongs of the anchoring device to penetrate through the carrier and to be deformed in response to engagement with a suitably configurated cam face in the chamber of a complementary retaining device. An advantage of such construction of the female component of the snap fastener and its attachment to the anchoring and retaining devices is that the attachment of the female component to the carrier is simplified, that mass-production of the snap fastener is facilitated, and that the parts of the snap fastener are less likely to be scratched. The likelihood of scratching a conventional snap fastener is particularly pronounced if the anchoring means comprises sharp prongs which can penetrate into the synthetic plastic material of the male or female component of the snap fastener. The components of the snap fastener are likely to be scratched when a large number of male or female components is dropped into a vessel wherein the synthetic plastic material of such components is contacted by a selected coloring agent. As a rule, such dyeing involves a thorough mixing of female mixing and male components of snap fasteners in a drum. By proceeding in a manner as proposed in the aforementioned German publication, the likelihood of extensive scratching of sensitive plastic components by the prongs of the anchoring devices is greatly reduced. It is particularly desirable to avoid scratching of those portions of a snap fastener which are readily visible when the male and female components are attached to garments or the like. On the other hand, scratching of certain portions of synthetic plastic male and female components is of lesser consequence if such portions are concealed when the male and female components are coupled to each other or are attached to carriers in the form of textile sheets or the like.

The heretofore known snap fasteners exhibit the drawback that the force with which the male and female components are held together is relatively small. It is normally desirable to assemble a snap fastener in such a way that the force which is required to join a male component to a female component is a fraction of the force which must be applied in order to separate such components from each other. Heretofore known proposals involve the selection of dimensions of the male and female components. This can affect the appearance of the snap fastener and is not always likely to ensure that the closing force is substantially smaller than the opening force. Therefore, many conventional snap fasteners are designed in such a way that the magnitude of the closing force approximates the magnitude of the opening force or that the magnitude of the opening force is reduced for the sole purpose of ensuring that it is not necessary to apply a pronounced closing force.

OBJECTS AND SUMMARY OF THE INVENTION

An object of the invention is to provide a snap fastener wherein the closing force which is required to attach the male component to the female component can be a small fraction of the opening force.

Another object of the invention is to provide a simple and inexpensive snap fastener of eye-pleasing appearance wherein the male and female components can be joined to each other with the exertion of a surprisingly small force without affecting the reliability of the connection as soon as such connection is established.

A further object of the invention is to provide a novel and improved female component of a snap fastener.

An additional object of the invention is to provide a novel and improved male component for use with the female component.

Still another object of the invention is to provide a novel and improved method of selecting the dimensions of male and female components in a snap fastener with a view to allow for operation with a relatively small closing force and with a much larger opening force.

The invention resides in the provision of a snap fastener, for example, for use on garments, which comprises a female component including an end wall having a first side and a second side, and a rim which surrounds the end wall and extends beyond one of the sides. The end wall has a substantially frustoconical central portion having a concave surface at the other side of the end wall and including a central opening and an elastically deformable female coupling element surrounding the opening. The snap fastener further comprises a male component including a male coupling element which is insertable into the female coupling element from the concave surface of the central portion of the end wall. The male coupling element includes a head having a maximum diameter which exceeds the diameter of the opening in the underformed condition of the female coupling element so that the female coupling element undergoes radial deformation during insertion as well as during extraction of the male coupling element.

The male component of the snap fastener further comprises a plate-like member having a central portion constituting the male coupling element. The plate-like member has a resilient annular portion which surrounds the male coupling element and can be provided with a circumferentially complete groove.

The snap fastener also comprises an anchoring device including a main body portion which is adjacent to the one side of the end wall of the female component and a plurality of prongs which extend from the main body portion in a direction away from the end wall. The rim overlies the main body portion of the anchoring device around the prongs, and the snap fastener further comprises a retaining device having an annular chamber for the prongs and a dome which is surrounded by the chamber and includes a top wall disposed opposite the frustoconical portion of the end wall and arranged to transmit finger pressure (either directly or indirectly) during insertion of the male coupling element into the female coupling element so as to hold the female component against movement with the male component. Such snap fastener further comprises a cover for the retaining device. The cover includes a portion which extends radially outwardly beyond the retaining device, a side facing the anchoring device, and a socket which is provided in the side of the cover and receives the retaining device. Such snap fastener is preferably designed in such a way that the radially outwardly extending portion of the cover has reinforcing ribs and recesses alternating with the ribs.

The male component of the just described snap fastener comprises the aforementioned plate for the male coupling element, and the plate has a first side from which the male coupling element extends and a second side. The male component further includes a peripheral wall which extends from the second side of the plate and the snap fastener further comprises an anchoring device including a main body portion which is adjacent to the second side of the plate and a plurality of prongs which extend from the main body portion in a direction away from the plate. The peripheral wall overlies the main body portion of the anchoring device around the prongs, and such snap fastener further comprises a retaining device having an annular chamber for the prongs and a dome surrounded by the chamber and including a top wall disposed opposite the male coupling element and serving to transmit finger pressure (either directly or indirectly) during insertion of the male coupling element into the female coupling element. The just outlined snap fastener can further comprise a cover for the retaining device which is associated with the male component. Such cover includes a portion extending radially outwardly beyond the retaining device and the cover has a side facing the anchoring device and a socket provided in such side and receiving the respective retaining device. The just mentioned cover can be provided with reinforcing ribs and with recesses which alternate with the ribs.

The end wall of the female component can be provided with a substantially annular channel which surrounds the female coupling element. The channel can be provided in the one side of the central portion of the end wall. Such channel can have a conical profile and its depth can increase in a direction from the rim toward the opening of the female component. The end wall which is provided with such channel can further include substantially radially extending webs or ribs which subdivide the channel into a plurality of arcuate or otherwise configurated sections. The female coupling element can be provided with radially extending slots which extend into the webs.

The female coupling element can include a substantially annular reinforcing portion which can constitute a bead of the central portion of the end wall.

At least one of the male and female components can contain or can consist of a suitable synthetic plastic material.

In accordance with a presently preferred embodiment of the invention, the male coupling element resembles a mushroom.

The novel features which are considered as characteristic of the invention are set forth in particular in the appended claims. The improved snap fastener itself, however, both as to its construction, and its mode of operation, together with additional features and advantages thereof, will be best understood upon perusal of the following detailed description of certain specific embodiments with reference to the accompanying drawing.

BRIEF DESCRIPTION OF THE DRAWING

FIG. 7 is a partly elevational and partly axial sectional view of a male component which can be assembled with the female component of FIGS. 1–2, and further showing an anchoring device which can be assembled with the male component for attachment to a garment or the like;

DESCRIPTION OF THE PREFERRED EMBODIMENTS

Figure 1:
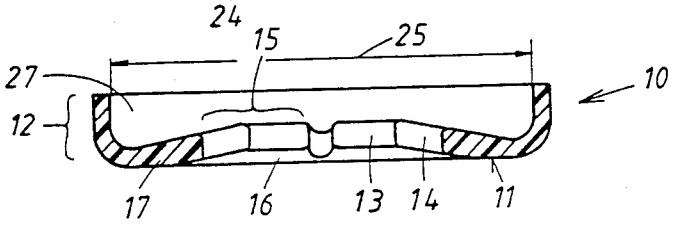
FIG. 1 is an axial sectional view of a female component of a snap fastener which embodies one form of the invention.
Figure 2:
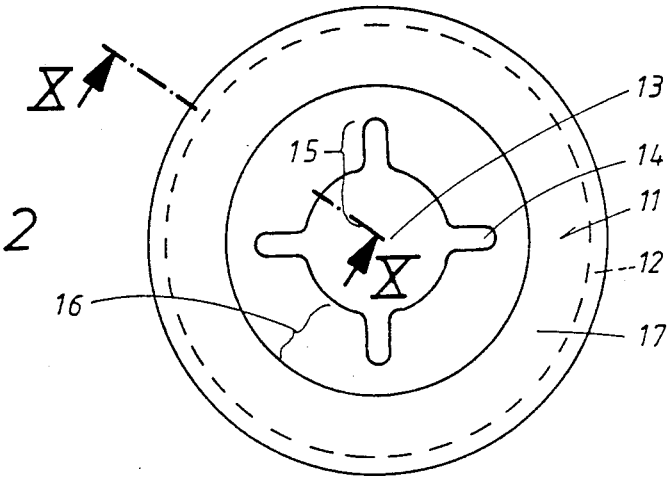
FIG. 2 is a bottom plan view of the female component which is shown in FIG. 1.
Figure 2:
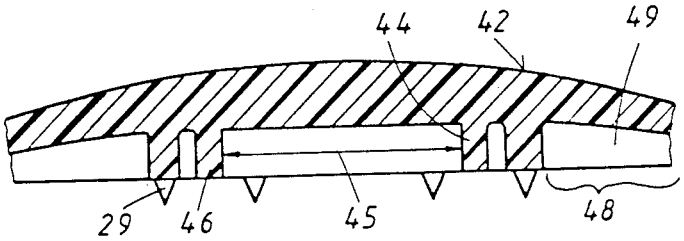

Referring first to FIGS. 1 and 2, there is shown a female component 10 of a snap fastener which embodies one form of the invention. The female component 10 is made of a suitable synthetic plastic material and includes an end wall 11 as well as a rim 12 which surrounds and extends beyond one side of the end wall. The end wall 11 is formed with a central opening 13 which is surrounded by a female coupling element 15 having four equidistant radially outwardly extending slots 14 each of which communicates with the opening 13. The slots 14 enable the female coupling element 15 to undergo radial expansion in response to the application of a force in the direction indicated by the arrow 64 of FIG. 8 or arrow 71 of FIG. 9. That (central) portion of the end wall 11 which defines the female coupling element 15 is denoted by the character 16 and has a frustoconical shape with a concave surface 61 (FIG. 8) disposed at the outer side 17 of the end wall 11. The outer side 17 is accessible to the male coupling element 55 (see FIG. 7) of the complementary male component 50 of the snap fastener when the two components are to be assembled in a manner as shown in FIG. 8. The general plane of the outer side 17 of the end wall 11 is denoted by the phantom line 18 of FIG. 4. The relatively small acute angle 19 denotes in FIG. 4 the inclination of the concave surface 61 of the central portion 16 with reference to the plane 18. The slope of the concave surface 61 is indicated in FIG. 4 by the line 63.

Figure 3:
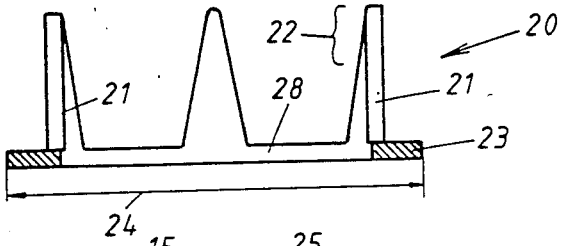
FIG. 3 is an axial sectional view of an anchoring device which can be assembled with the female component of FIGS. 1 and 2.
Figure 5:
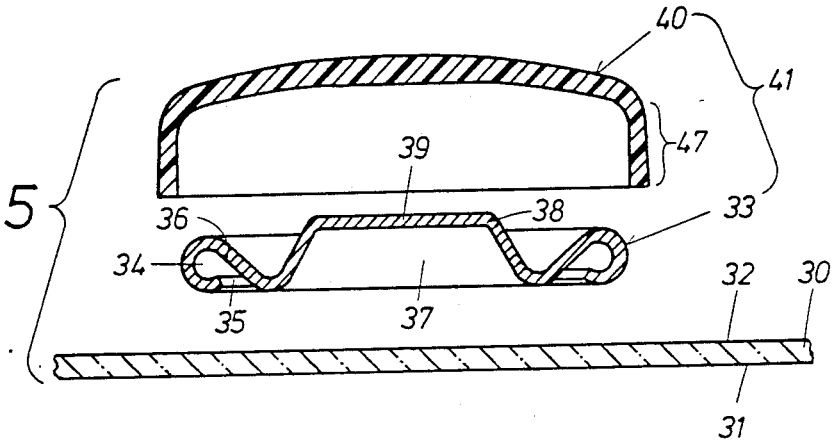
FIG. 5 is an axial sectional view of a retaining device for the anchoring device of FIGS. 3–4 and of a decorative cover which can be assembled with the retaining device, further showing a piece of textile carrier material for the female component of FIGS. 1 and 2.

FIG. 3 shows an anchoring device 20 which resembles a toothed ring and can be assembled with the female componen-t 10 preparatory to attachment of the female component to a piece of clothing, for example, to a textile carrier sheet 30 which is shown in FIG. 5. The anchoring device 20 comprises an annular main body portion 23 having an outer diameter 24 which approximates but is at least slightly less than the inner diameter 25 of the rim 12 of the female component 10. The anchoring device 20 further comprises a set of, for example, four equidistant prongs 21 which extend from one side of the main body portion 23 around a centrally located aperture 28 of the device 20. The tips 22 of the prongs 21 can be deformed in a manner to be described with reference to FIG. 5 in order to couple the anchoring device 20 to a retaining device 33. The arrangement is such that the anchoring device 20 is located at one (rear) side 31 of the carrier 30 and the retaining device 33 is located at the other (front) side 32 of the carrier 30 preparatory to attachment of the devices 20 and 33 to each other. The entire anchoring device 20 is a single piece of sheet metal which is shaped in a suitable stamping machine with its prongs 21 originally located in the general plane of the main body portion 23 prior to their bending out of the plane of the main body portion 23 to the positions shown in FIG. 3. The anchoring device 20 can be provided with fewer than four or more than four prongs 21 without departing from the spirit of the invention.

Figure 4:
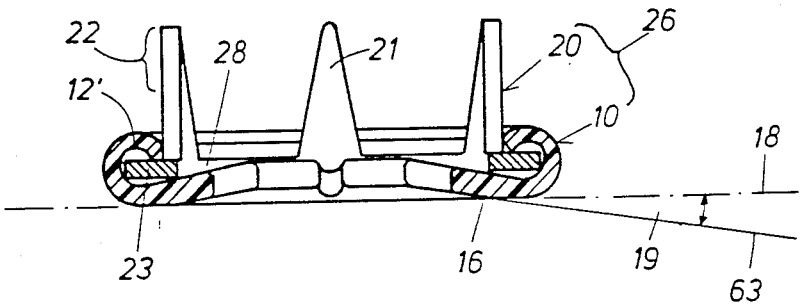
FIG. 4 is an axial sectional view of the female component of FIGS. 1–2 assembled with the anchoring device of FIG. 3.

When the main body portion 23 of the anchoring device 20 is inserted into the space 27 within the confines of the rim 12 forming part of the female component 10, the rim is deformed in a manner as shown in FIG. 4 so that its portion 12' overlies that side of the main body portion 23 from which the prongs 21 extend. This completes the attachment of the female component 10 to the anchoring device 20 so that such parts together constitute an assembly or unit 26 which is ready to be attached to the retaining device 33 as soon as the tips 22 of the prongs 21 have penetrated through the carrier 30 in a direction from the rear side 31 toward and beyond the front side 32 of the carrier. As shown in FIG. 4, the frustoconical central portion 16 of the end wall 11 of the female component 10 extends, at least in part, into the central aperture 28 of the main body portion 23 of the anchoring device 20.

The retaining member 33 is a piece of sheet metal which can be mass-produced in an available machine and is formed with an annular chamber 34 having an annular inlet 35 and including a ring-shaped deforming cam 36 for the tips 22 of the prongs 21. The central portion of the retaining device 33 is a dome 38 which defines a compartment 37 facing the front side 32 of the carrier 30 and extending to a top wall 39 which can be depressed (directly or indirectly) by a finger so as to oppose a movement of the unit 26 with the male component 50 of the snap fastener when the male coupling element 55 of the component 50 is being introduced into the female coupling element 15 of the female component 10. The diameter of the annular inlet 35 of the retaining device 33 is the same as the diameter of the circle which is defined by the tips 22 of the prongs 21 on the anchoring device 20.

In order to assemble the unit 26 with the retaining device 33, the tips 22 of the prongs 21 are caused to penetrate through the carrier 30 of FIG. 5 from the rear side 31 toward and beyond the front side 32 so that such tips can penetrate into the chamber 34 by way of the inlet 35. The tips 22 are thereupon deformed as a result of engagement with the deforming cam 36 and are bent radially outwardly so as to permanently couple the anchoring device 20 with the retaining device 33 and, consequently, more or less permanently couple the unit 26 to the carrier 30. The unit 26 and the retaining device 33 can be assembled by hand or in automatic or semi-automatic machines. The presently preferred purpose of the dome 38 and its top wall 39 is to allow for convenient manipulation of the female component 10 during its attachment to the male component 50 of FIG. 7.

Though it is possible to use the retaining device 33 without any concealment, it is often preferred to enhance the appearance of the snap fastener by confining the retaining device 33 in a decorative cover or cup one embodiment of which is shown in FIG. 5. This cover is denoted by the character 40 and includes a marginal portion 47 with an inner diameter such that it can receive the entire retaining device 33. In the next step, the free end of the marginal portion 47 is bent over the retaining device 33 so that it comes close to the inlet 35 and practically completely confines the retaining device. The remainder of the retaining device 33 is confined by the carrier 30 as soon as the prongs 21 of the anchoring device 20 are properly deformed and permanently held in the chamber 34 of the retaining device.

The cover 40 can serve any one of a wide variety of decorative purposes in order, e.g., to blend the snap fastener into the carrier 30 or to highlight the position of the snap fastener. For example, the cover 40 can be made of a synthetic plastic material which can be coated so that its color or shade is identical with or similar to that of the female component 10 of the snap fastener. Furthermore, the color of the cover 40 and/or female component 10 can match or be similar to the color of the material of the carrier 30. If the color of the front side 32 of the carrier 30 deviates from the color of the rear side 31, the color of the cover 40 can match that of the first side 32 and the color of the female component 10 can match that of the rear side 31.

When the cover 40 is properly affixed to the retaining device 33, such parts together form a unit or assembly 41 which can be manipulated as an entity, for example in a dyeing vat or the like. It will be noted that the unit 41 does not exhibit any projecting prongs or similar protuberances which could scratch the neighboring unit or units 41 in a vessel or the like, for example, during agitation of such components in a dyeing liquid. It will be noted that the prongs 21 form part of the unit 26. If several units 26 are dropped into a vessel for the purpose of dyeing or for another reason, the fact that some of the prongs 21 may scratch the adjacent female components 10 is of no particular consequence since a substantial part of each female component 10 is concealed by the respective rear side 31 of the carrier 30 when the unit 26 is properly attached to a unit 41, and also because the remainder of the female component 10 is practically completely concealed by the male component 50 when the male coupling element 55 of the component 50 is properly introduced into the female coupling element 15. The side 31 of the carrier 30 is the rear side of a garment which includes the carrier so that the presence of scratches (if any) on the female component 10 is highly unlikely to be detected, even by a very observant person.

Figure 6:
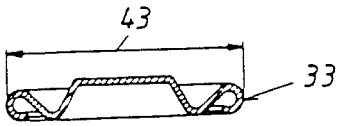
FIG. 6 is an enlarged fragmentary axial sectional view of a cover which can be utilized in lieu of the cover shown in FIG. 5, and further showing a retaining device which can be assembled with a modified cover.

FIG. 6 shows a modified decorative cover or cap 42 which can be used as a substitute for the relatively simple decorative cover 40 of FIG. 5. The cover 42 is also made of a suitable synthetic plastic material and includes a centrally located socket 44 defining a chamber with an inner diameter 45 which slightly exceeds the diameter 43 of the retaining device 33 (shown in the lower portion of FIG. 6). The peripheral portion 48 of the cover 42 extends radially outwardly well beyond the socket 44 and can be provided with alternating radially extending reinforcing ribs 49 and recesses. In other words, the portion 48 of the cover 42 can resemble a honeycomb or a like cellular structure. The socket 44 extends from that side of the cover 42 which faces the front side 32 of the carrier 30 (not shown in FIG. 6). When the retaining device 33 is properly inserted into the socket 44, portions of the wall 46 surrounding the socket 44 are deformed so as to ensure that the retaining device 33 is properly held in the socket and is ready to be assembled with the anchoring device 20 of a unit 26.

The inner side of the cover 42 is further provided with teeth 29 which extend beyond the ribs 49 and can penetrate into the material of the carrier 30 so as to prevent angular movements of the cover 42 and its retaining device 33 relative to the carrier.

Figure 7:
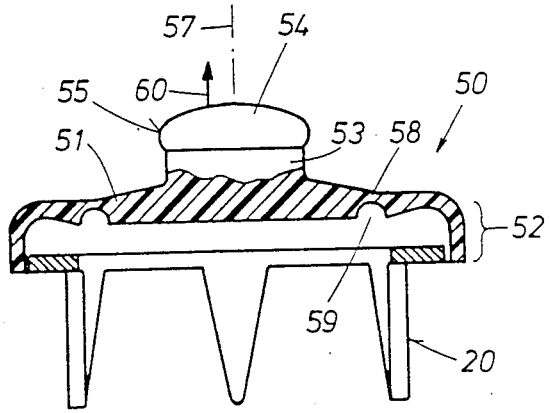
Figure 8:
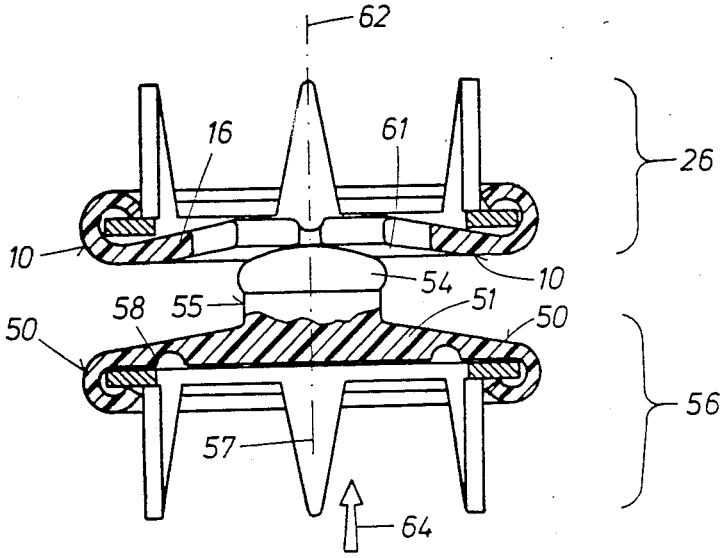
FIG. 8 is a partially elevational and partially axial sectional view of the structures of FIGS. 4 and 7, showing the manner of attaching the male coupling element of the male component to the female coupling element of the female component of the improved snap fastener.

Referring to FIG. 7, the male component 50 of the snap fastener comprises a resilient plate-like end wall 51 (hereinafter called plate for short) the central portion of which constitutes the male coupling element 55. The component 50 and an anchoring device 20 (which is preferably identical with the anchoring device of FIG. 3) can be assembled into a further unit or assembly 56 (see FIGS. 8 and 9). To this end, the peripheral wall or rim 52 which surrounds the plate 51 can be bent over the main body portion of the respective anchoring device 20 so as to surround the adjacent portions of the prongs and to ensure that the male component 50 and the thus confined anchoring device 20 constitute a unit or assembly 56 which can be treated in a dyeing vat or for other purposes preparatory to attachment of a cover 40 or 42. The manner in which a cover 40 or 42 can be affixed to the unit 56 is not specifically shown because it is identical with the manner described in connection with FIG. 5. The same applies for the attachment of a retaining device 33 to the prongs of the anchoring device 20 which is shown in FIG. 7. The unit 56 is then attached to another piece of garment or to another portion of the same garment (i.e., to another carrier) before the two garments or the two pieces of the same garment can be coupled to each other by inserting the male coupling element 55 into the female coupling element 15.

The male coupling element 55 resembles a mushroom and includes an arrowhead 54 and a smaller-diameter portion in the form of a neck or shank 53 which is integral with the head 54 as well as with the central portion of the plate 51. The resiliency of an annular weakened portion 58 of the plate 51 is enhanced by the provision therein of a circumferentially complete groove 59. The groove 59 is provided in the inner side of the plate 51, i.e., in that side which faces away from the male coupling element 55. The common center of the annular weakened portion 58 and of its groove 59 is located on the axis 57 of the male coupling element 55. Such coupling element is located centrally of the plate 51. When the male coupling element 55 is pulled in the direction of the arrow 60 shown in FIG. 7, the weakened portion 58 of the plate 51 yields and enables the male coupling element to move axially relative to the peripheral wall 52. The plate 51 exhibits the tendency to return the male coupling element 55 to a starting position. The advantages of the weakened portion 58 of the plate 51 will be described in detail with reference to FIGS. 8 to 11.

The manner in which the unit 56 including the male component 50 and the corresponding anchoring device 20 can be treated in a dyeing machine is the same as described above in connection with the female component 10 and covers 40 and 42. The male component 50 can be made of a suitable synthetic plastic material which can readily accept a dye so that its color will match or will not clash with the color of the female component 10, cover 40 or 42, front side 31 of a carrier 30 or the rear side 32 of a carrier.

Referring to FIG. 8, there is shown a presently preferred mode of assembling the unit 26 with the unit 56. It will be appreciated that the prongs which are shown in FIG. 8 are already deformed when the male component 50 is assembled with the female component 10. The arrangement is such that the apex 70 of the head 54 of the male coupling element 55 is caused to engage the concave surface 61 of the frustoconical central portion 16 of the end wall 11 of the female component 10 by moving in the direction indicated by the arrow 64. At such time, the surface 61 serves as a centering means which causes the axis 57 of the male component 50 and of its male coupling element 55 to coincide with the axis 62 of the female coupling element 15. The slope of the surface 61 is sufficient to ensure rapid and reliable centering, especially in view of the fact that the head 54 of the male coupling element 55 can be said to constitute a rudimentary arrowhead which allows for ready penetration of the male coupling element 55 into the complementary female coupling element 15.

Figure 10:
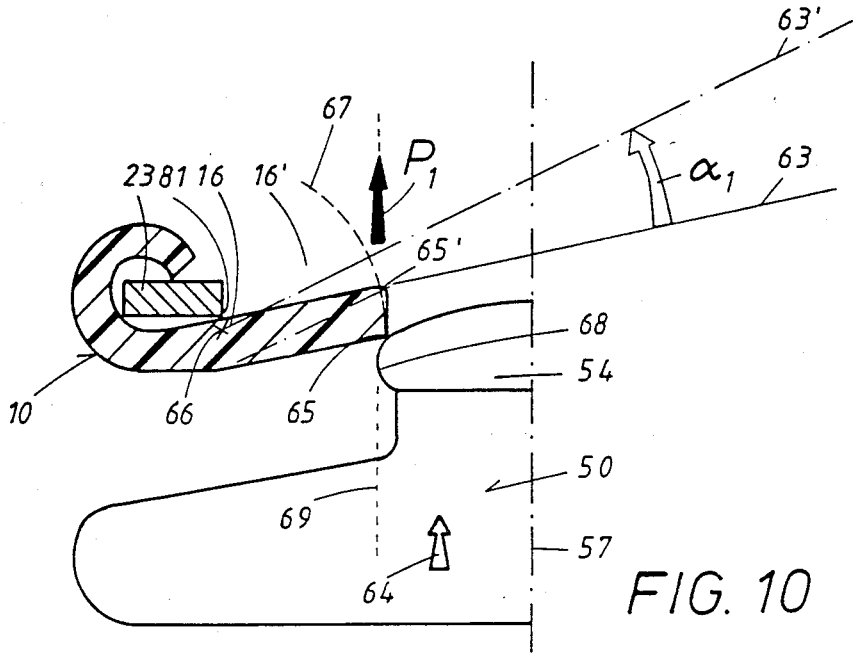
FIG. 10 is an enlarged fragmentary axial sectional view as seen in the direction of arrows from the line X—X in FIG. 2 and further shows the male component in a position it assumes preparatory to introduction of its male coupling element into the female coupling element of the female component.

The manner in which the end wall 11, and particularly its central portion 16, is deformed during penetration of the head 54 into the opening 13 of the end wall 11 can be best seen in FIG. 10. The arrow 64 again denotes the direction in which the male coupling element 55 is caused to penetrate into the opening 13' During the first stage of such penetration, the maximum-diameter portion 68 of the head 54 engages the annular edge 65 around the inner end of the central opening 13 in the frustoconical central portion 16 of the end wall 11. As the male component 50 continues to advance in the direction of the arrow 64 so that the maximum-diameter portion 68 of the head 54 advances along a path 69 which is indicated by a broken line, the annular edge 65 around the inner end of the opening 13 yields and moves along an arcuate path 67 to reach the position 65' in which the head 54 is free to pass through the opening 13.

Though the end wall 11 is elastic, its elasticity in the direction of the arrow 64 is limited by the main body portion 23 of the anchoring device 20 because the central portion 16 of the end wall 11 must flex along a hinge or joint 66 (indicated by the symbol "x") at the radially innermost edge 81 of the main body portion 23. In other words, the lever arm of each portion of the female coupling element 15 is relatively short.

During introduction of the head 54 into the opening 13, the inclination of the outer side 63 of the central portion 16 changes from the solid-line position to the phantom-line position 63' of FIG. 10. The angle which is covered by the outer side 63 of the central portion 16 during movement of such central portion from its solid-line position to the phantom line position 16' is denoted by the character $alpha_1$. At such time, the annular edge 65 at the inner end of the opening 13 assumes the position 65'. The length of the arrow $P_1$ in FIG. 10 denotes the relatively small force which is required to flex the central portion 16 along the hinge 66 in order to move it from the solid-line position to the position 16' and to thus allow the head 54 of the male coupling element 55 of the male component 50 to penetrate through the opening 13 of the female coupling element 15.

Figure 9:
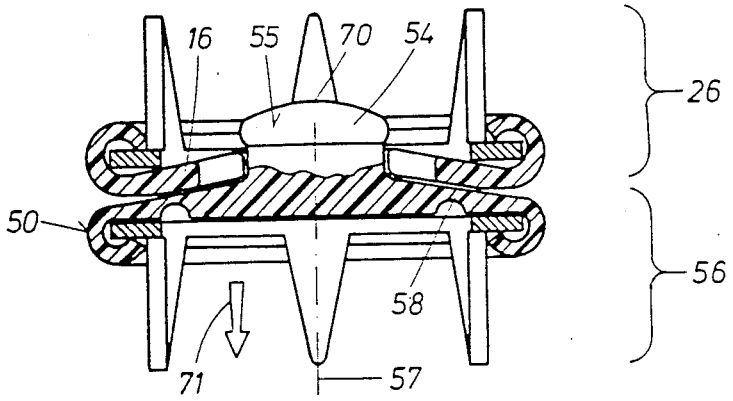
FIG. 9 illustrates the structure of FIG. 8 upon completed coupling of the male component to the female component.

When the attachment of the unit 56 to the unit 26 is completed, these units assume the positions which are shown in FIG. 9. Since the material of the end wall 11 is at least slightly elastic, the female coupling element 15 snaps against the adjacent frustoconical outer side of the plate 51 as soon as the head 54 has passed through the opening 13 so that the female coupling element 15 then surrounds the shank 53 of the male coupling element 55 and the coupling element 55 is reliably held in the coupling element 15. At such time, the central portion 16 of the end wall 11 can be said to resemble a hollow arrowhead surrounding the arrowhead which is constituted by the head 54 of the male coupling element 55.

Figure 11:
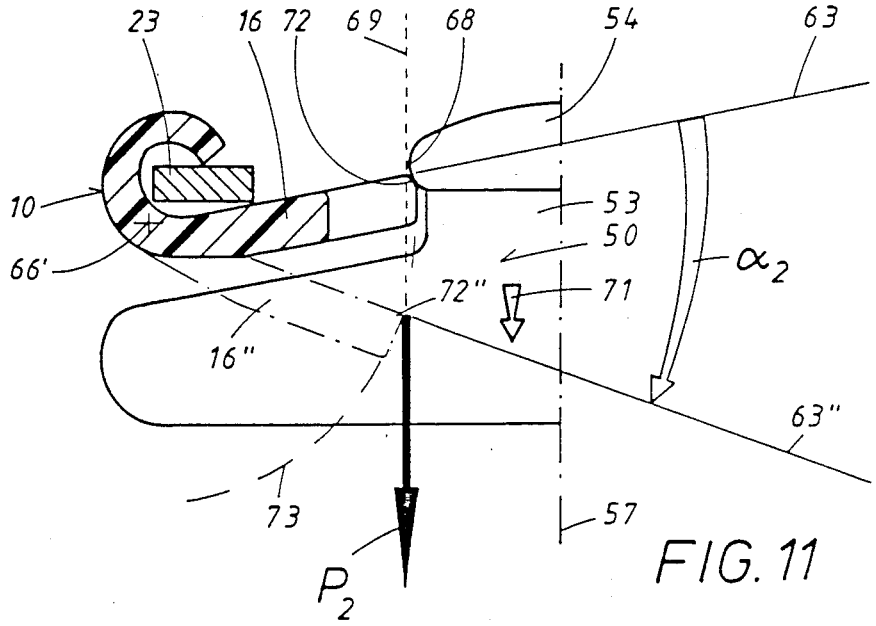
FIG. 11 illustrates the structure of FIG. 10 preparatory to extraction of the male coupling element from the female coupling element.

If the male component 50 is to be separated from the female component 10, the assembly 56 must be pulled in the direction which is indicated in FIG. 9 by the arrow 71. The manner in which the disengagement takes place is shown in detail in FIG. 11. The maximum-diameter portion 68 of the head 54 of the male coupling element 55 again advances along the broken-line path 69 whereby the head engages the outer annular edge 72 of the surface bounding the central opening 13 of the female coupling element 15. The hinge 66 is then transferred to the position 66' of FIG. 11 because the main body portion 23 of the anchoring device 20 which is confined in the rim 12' of the female component 10 does not offer any resistance to flexing of the end wall 11 and of its frustoconical central portion 16. It will be seen that the extraction of head 54 from the female component 10 by way of the opening 13 involves a deformation of the entire end wall 11 in contrast to deformation of a relatively small portion of the end wall 11 during introduction of the head 54 into the female coupling element 15 (FIG. 10). The annular edge 72 of the surface bounding the central opening 13 then travels along an arcuate path 73 which is indicated in FIG. 11 by a broken line, and such edge ultimately reaches the position 72" in which its diameter matches the diameter of the maximum-diameter portion 68 of the head 54 so that the head can be extracted from the female coupling element 15 by moving in the direction of the arrow 71. The original inclination of the outer side 63 of the central portion 16 is indicated by a solid line, and the inclination of such outer side at the time when the head 54 is free to pass through the opening 13 is indicated by the line 63". The angle $alpha_2$ between the lines 63 and 63" is much larger than the $angle_1$ of FIG. 10. Furthermore, the force $P_2$ which is required to extract the head 54 from the female coupling element 15 is several times the force $P_1$ (FIG. 10) which is needed to introduce the head 54 into and to cause it to advance beyond the opening 13 during assembly of the male component 50 with the female component 10. It will be seen that, during extraction of the head 54, the concave surface of the central portion 16 is converted into a convex surface (see the position 16" of the central portion 16) as a result of a pull exerted by the head 54 upon the annular edge 72. The central portion 16 snaps back to reassume the position of FIGS. 9 or 8 as soon as the extraction of the head 54 is completed. During tilting from the solid-line position to the phantom-line position 16" of FIG. 11, the central portion 16 of the end wall 11 must move through a dead-center position in which its plane coincides with the plane 18 of FIG. 4.

The advantages of the feature that the force $P_2$ exceeds the force $P_1$ will be readily appreciated. Thus, the retaining action of the improved snap fastener is very pronounced because the likelihood of accidental or unintentional separation of the male coupling element 55 from the female coupling element 15 is remote. The force $P_2$ can be several times (for example, three to five times) greater than the force $P_1$. The exact relationship of the magnitudes of forces $P_1$ and $P_2$ can be selected by the designer within a wide range. Such relationship can be altered by properly selecting the thickness, resiliency and inclination of the central portion 16 of the end wall 11 of the female component 10, the diameter of the portion 68 of the head 54, the depth of the slots 14 in the female component 15 and/or the inner diameter of the main body portion 23 of the anchoring device 20.

The weakened portion 58 of the plate 51 which forms part of the male component 50 plays an important role in connection with the attachment of the male coupling element 55 to, and its detachment from, the female coupling element 15. This will be readily appreciated by considering FIGS. 7, 8 and 9. During attachment of the male component 50 to the female component 10, the dome 38 of the corresponding retaining device 33 (which is confined in the cover 40 or 42) prevents the central portion of the plate 51 from yielding in spite of the provision of the groove 59. In other words, the elasticity of the weakened portion 58 of the plate 51 is more or less immaterial.

However, when the male component 50 is pulled in the direction of the arrow 71 shown in FIG. 9, the weakened portion 58 and its elasticity enable the male coupling element 55 to move axially relative to the peripheral wall 52 of the male component 50. Such movement of the male coupling element 55 relative to the peripheral wall 52 is indicated in FIG. 7 by the aforementioned arrow 60. This brings about a so-called snap action during application of a portion of the opening force $P_2$ without actual separation of the components 10 and 50 unless the person applies the full force $P_2$ which is necessary to ensure that the head 54 is actually extracted from the female coupling element 15. In other words, the weakened portion 58 of the resilient plate 51 can give during application of certain stresses which tend to separate the components 10 and 50 from each other; however actual separation of such components can take place only when the full force $P_2$ is applied.

Figure 13:
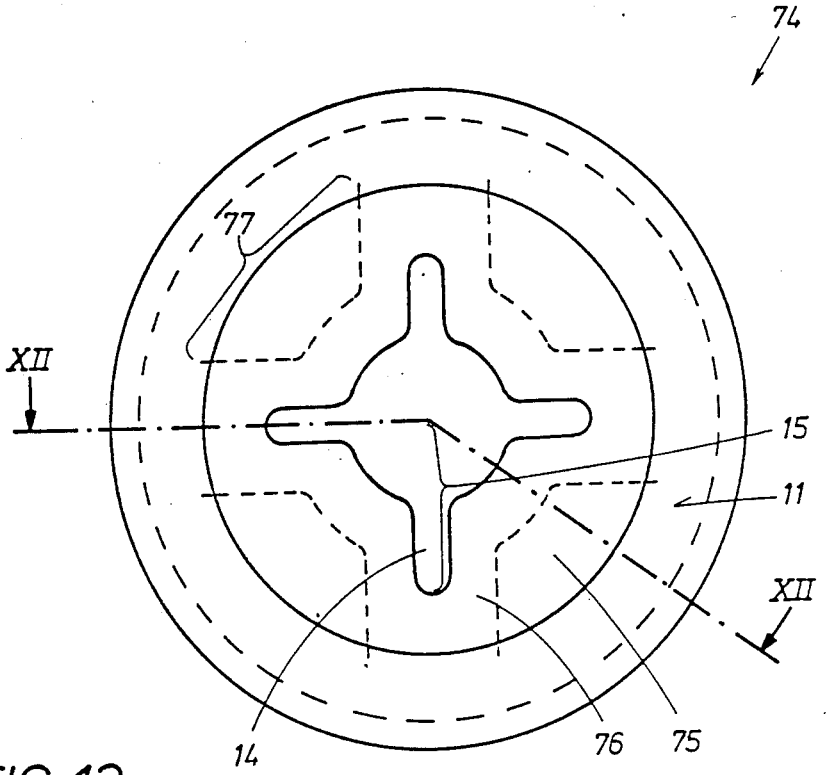
FIG. 13 is a bottom plan view of the female component which is shown in FIG. 12.
Figure 12:
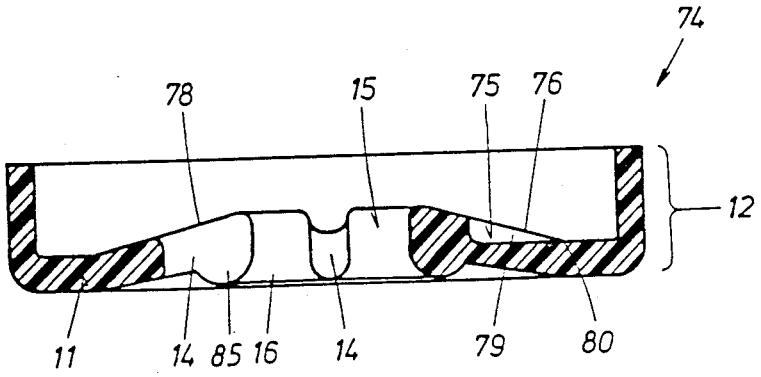
FIG. 12 is an axial sectional view of a modified female component of the improved snap fastener as seen in the direction of arrows from the line XII—XII of FIG. 13.

Referring to FIGS. 12 and 13, there is shown a modified female component 74 which can be utilized instead of the female component 10 of FIGS. 1 and 2. All such parts of the component 74 which are identical with or clearly analogous to the corresponding parts of the component 10 are denoted by similar reference characters. That side of the end wall 11 from which the rim 12 extends is provided with a concentric channel 75 which surrounds the female coupling element 15 of the central portion 16. The end wall 11 is further formed with a set of, for example, four equidistant radially extending reinforcing webs or ribs 76 which subdivide the channel 75 into four equidistant sections 77 (indicated in FIG. 13 by broken lines). The radial slots 14 of the female coupling element 15 extend into the respective reinforcing webs 76. The channel 75 has a substantially conical profile 79 and its base (maximum-diameter portion) 80 is adjacent to the inner side of the rim 12. The depth of the channel 75 increases gradually in a direction from the rim 12 toward the central opening of the end wall 11. The edge faces of the webs 76 merge gradually into the convex side 78 of the female coupling element 15.

An advantage of the channel 75 is that it. enhances the elasticity of the female component 74, and particularly of the female coupling element 15. Such increased elasticity is often desirable not only during introduction of the male coupling element but also during extraction of the male coupling element from the female coupling element 15. Furthermore, the provision of the channel 75 enables the designer of the snap fastener to select the magnitude of the force $P_1$ and/or the magnitude of the force $P_2$ and/or the ratio of such forces within a desired range. The conical profile 79 of the channel 75 reduces the likelihood of the so-called notch effect. The webs 76 reduce the likelihood of radial cracking of the end wall 11 in the region of its central portion 16 and female coupling element 15.

If desired, the female coupling element 15 can be provided with an annular reinforcing bead 85 (indicated schematically in FIG. 12). The purpose of the bead 85 is to compensate for wear upon the female coupling element 15 in response to repeated introduction and extraction of the male coupling element 55.

An important advantage of the improved snap fastener is that the magnitude of the opening force $P_2$ can greatly exceed the magnitude of the closing force $P_1$ without necessitating the use of a small male coupling element and a large female coupling element or vice versa. This is attributable to the novel configuration of the frustoconical central portion 16 of the female component 10 or 74. The mode of deformation of the central portion 16 during penetration of the male coupling element 55 into the female coupling element 15 is substantially different from the mode of deformation of the central portion 16 during extraction of the head 54. As described above, the extent of deformation of the central portion 16 during insertion of the head 54 is much smaller than the extent of deformation of the female coupling element 15 during disengagement of the elements 15 and 55. The disengagement necessitates a movement of the central portion 16 from one side of its dead-center portion, to such dead-center position, and thereupon to the other side of the dead-center position (compare the solid line position of the central portion 16 in FIG. 11 with the phantom-line position 16").

Another important advantage of the improved snap fastener is that the central portion 16 of the end wall 11 of the female component 10 or 74 cooperates with the head 54 of the male coupling portion 55 to properly center the two coupling portions during penetration of the head 54 into and beyond the central opening 13. This contributes to convenience of attachment of the male component 50 to the female component 10 or 74 with a relatively small force ($P_1$)

The provision of the weakened portion 58 on the plate 51 of the female component 50 also contributes to convenience of attachment of the male component to the female component as well as to a reduction of the likelihood of accidental separation of the two components except in response to the exertion of the full force $P_2$. As mentioned above, the resiliency of the portion 58 is of no consequence or is of little consequence during coupling of the element 55 to the element 15 but such resiliency enables the element 55 to move axially relative to the plate portion around the groove 59 in response to the application of stresses to the male or female component while the snap fastener is fully assembled, namely while the element 55 extends into and is engaged by the element 15. The elasticity of the portion 58 furnishes a restoring force which tends to maintain the male coupling element 55 in a predetermined axial position with reference to the peripheral wall 52 of the male component 50. Such restoring force must be overcome (by the full application of opening force $P_2$) before the male component 50 can be separated from the female component 10 or 74. The just discussed "give" of the male component 50 is desirable and advantageous because it greatly reduces the likelihood of accidental separation of the male coupling element 55 from the female coupling element 15.

The provision of retaining devices 33 with domes 38 simplifies the manipulation of the components of the snap fastener The top walls 39 of the domes 38 render it possible to apply substantial forces in a direction to couple the element 55 with the element 15. Moreover, the domes 38 reduce the likelihood of undesirable temporary or permanent deformation of component parts of the snap fastener. The application of forces by way of the top walls 39 is particularly desirable during deformation of the tips 22 of the respective prongs 21, namely during assembly of the unit 41 of FIG. 5 or during assembly of an analogous unit including the male component 50 and the anchoring device 20 of FIG. 7 with a cover 40 or 42 and a retaining device 33.

An advantage of the relatively simple decorative cover 40 of FIG. 5 is that it can be readily dyed so that the distribution of a selected color is uniform throughout the entire cover. Similar advantages can be achieved with the modified cover of 42 because the provision of the socket 44 and recesses which alternate with the ribs 49 reduces the overall thickness of the major part of the cover 42 to such an extent that it can be properly dyed all the way between its inner and outer sides. Furthermore, the provision of recesses which alternate with the ribs 49 allows for a reduction of the overall weight of the cap 42.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A snap fastener, particularly for use on garments, comprising a cup-shaped female component including a conical end wall having a convex inner side and a concave outer side substantially parallel to said inner side, and a rim surrounding said end wall and extending beyond said inner side, said end wall including a central portion having a central opening and an electrically deformable female coupling element surrounding said opening; a first anchoring device including an annular first main body portion adjacent the inner side of said end wall and having an aperture and a ring-shaped inner edge face surrounding said aperture, said first main body portion surrounding said female coupling element and said first anchoring device further comprising a ring-shaped outer edge face surrounding said first main body portion and a plurality of deformable first anchoring elements extending from said first main body portion in a direction away from said end wall, said rim overlying said first main body portion around said first anchoring element; a first retaining device having a first chamber for said first anchoring elements; a male component including a male coupling element insertable into said female coupling element from the concave side of said end wall, said male coupling element including a heat having a maximum diameter exceeding the diameter of said opening in the undeformed condition of said female coupling element so that the female coupling element undergoes radial deformation during insertion as well as during extraction of said male coupling element, said male coupling element further including a plate-like member having a first side facing said head and a second side, a peripheral wall extending from the second side of said plate-like member and a shank connecting said head with said plate-like member, said head having a shoulder facing said plate-like member and said head further having means for deforming said female coupling element of said end wall only within the inner edge face by increasing the conicity of said concave inner side with the exertion of a first force during insertion of said male coupling element into said female coupling element, said deforming means including means for flexing said female coupling element along said inner edge face until the head passes through said opening and said shoulder having means for deforming substantially the entire end wall all the way to said outer edge face with the exertion of a greater second force during extraction of said male component from said female component at which time the entire end wall undergoes deformation in a direction counter to that during insertion of said male coupling element, said deforming means including means for moving said end wall to and beyond a dead-center position in which said end wall is substantially flat and on to a position in which said inner and outer sides are respectively concave and convex as a result of deformation of said female coupling element by said shoulder and in which the diameter of said central opening is increased beyond the diameter of said head; a second anchoring device including a second main body portion adjacent the second side of said plate-like member and a plurality of second deformable anchoring elements extending from said second main body portion in a direction away from said plate-like member, said peripheral wall overlying said second main portion around said second anchoring elements; and a second retaining device having a second chamber for said second anchoring elements.

2. The snap fastener of claim 1, wherein said plate-like member has a resilient annular portion surrounding said male coupling element.

3. The snap fastener of claim 2, wherein said resilient annular portion has a circumferentially complete groove.

4. The snap fastener of claim 1, wherein said first retaining device further comprises a dome surrounded by said first chamber and including a top wall disposed opposite said central portion and arranged to transmit finger pressure during insertion of said male coupling element into said female coupling element so as to hold the female component against movement with the male component.

5. The snap fastener of claim 4, further comprising a cover for said first retaining device, said cover including a portion extending radially outwardly beyond said first retaining device, a side facing said first anchoring device and a socket provided in said side of said cover and receiving said first retaining device.

6. The snap fastener of claim 5, wherein said portion of said cover has reinforcing ribs and recesses alternating with said ribs.

7. The snap fastener of claim 1, wherein said second retaining device has a dome surrounded by said second chamber and including a top wall disposed opposite said male coupling element and arranged to transmit finger pressure during insertion of said male coupling element into said female coupling element.

8. The snap fastener of claim 7, further comprising a cover for said first retaining device, said cover including a portion extending radially outwardly beyond said first retaining device, said cover further having a side facing said second anchoring device and a socket provided in said side of said cover and receiving said first retaining device.

9. The snap fastener of claim 8, wherein said portion of said cover has reinforcing ribs and recesses alternating with said ribs.

10. The snap fastener of claim 1, wherein said end wall has a substantially annular channel surrounding said female coupling element.

11. The snap fastener claim 10, wherein said channel is provided in said convex side of said end wall.

12. The snap fastener of claim 11, wherein said channel has a conical profile.

13. The snap fastener of claim 11, wherein the depth of said channel increases in a direction from said rim toward said opening.

14. The snap fastener of claim 10, wherein said end wall has substantially radially extending webs subdividing said channel into a plurality of sections.

15. The snap fastener of claim 1, wherein said female coupling element includes a substantially annular reinforcing portion.

16. The snap fastener of claim 15, wherein said reinforcing portion is a bead of the central portion of said end wall.

17. The snap fastener of claim 1, wherein at least one of said components contains a synthetic plastic material.

18. The snap fastener of claim 1, wherein said male coupling element is mushroom-shaped.

* * * * *